US006647971B2

(12) United States Patent
Vaughan et al.

(10) Patent No.: US 6,647,971 B2
(45) Date of Patent: Nov. 18, 2003

(54) INTEGRATED EGR VALVE AND COOLER

(75) Inventors: Richard J. Vaughan, Ormond Beach, FL (US); Dimitri L. Vamvakitis, Pontiac, MI (US); Jerry Holden, Smithville, TN (US); Jack Morais, Clarkston, MI (US)

(73) Assignee: Cooper Technology Services, LLC, Findlay, OH (US)

( * ) Notice: Subject to any disclaimer, the term of this patent is extended or adjusted under 35 U.S.C. 154(b) by 0 days.

(21) Appl. No.: 10/149,922

(22) PCT Filed: Dec. 14, 2000

(86) PCT No.: PCT/US00/33958

§ 371 (c)(1),
(2), (4) Date: Sep. 6, 2002

(87) PCT Pub. No.: WO01/44651

PCT Pub. Date: Jun. 21, 2001

(65) Prior Publication Data

US 2003/0047171 A1 Mar. 13, 2003

Related U.S. Application Data

(60) Provisional application No. 60/170,649, filed on Dec. 14, 1999.

(51) Int. Cl.[7] ..... F02M 25/07
(52) U.S. Cl. ..... 123/568.12; 123/568.27
(58) Field of Search ..... 123/568.12, 568.27

(56) References Cited

U.S. PATENT DOCUMENTS

| | | | | |
|---|---|---|---|---|
| 4,134,377 | A | 1/1979 | Bamsey et al. | |
| 5,785,030 | A | 7/1998 | Paas | |
| 6,116,026 | A | 9/2000 | Freese, V | |
| 6,170,476 | B1 * | 1/2001 | Cook et al. | 123/568.27 |
| 6,213,105 | B1 * | 4/2001 | Banzhaf et al. | 123/568.12 |

* cited by examiner

*Primary Examiner*—Henry C. Yuen
*Assistant Examiner*—Arnold Castro
(74) *Attorney, Agent, or Firm*—Carlson, Gaskey & Olds

(57) ABSTRACT

An exhaust gas recirculation (EGR) cooling system includes a valve and a cooler. A motor opens the valve allowing hot fluid exhaust gas to flow into the valve. Cooling fluid continuously flows in and circulated around the valve, reducing the amount of heat transfer from the hot fluid to the valve components. The hot fluid travels through a plurality of tubes in the cooler, continuing to transfer heat to the cooling fluid. As the hot fluid is cooled, the unburned gas in the hot fluid is recycled to be burned by the engine.

16 Claims, 2 Drawing Sheets

INTEGRATED EGR VALVE AND COOLER

This application claim the benefit of Provisional application Ser. No. 60/170,649, filed Dec. 14, 1999.

BACKGROUND OF THE INVENTION

The subject invention relates to exhaust gas recirculation (EGR) within a combustion engine.

EGR systems are increasingly being utilized to improve the efficiency of engines and reduce the harmful effects of exhaust gas on the environment. As an engine burns fuel, it produces an exhaust gas which contains unburned fuel and other impurities. The exhaust gas is redirected through the engine to burn any unburned fuel. Reburning the exhaust gas before it is released reduces the harmful effects of the exhaust gas on the atmosphere and enables the vehicle to meet government emission standards.

In order to recirculate the exhaust gas, EGR systems typically include a valve and a cooler. The valve regulates the amount of exhaust gas that is introduced back into the engine. The cooler cools the exhaust gas to a specified temperature which condenses the unburned fuel.

Prior EGR system include a separate valve and cooler. A drawback to utilizing a valve and cooler as separate components is that additional tubing is necessary, reducing the amount of space in the engine compartment. Additionally, the additional tubing allows the hot fluid to lose and/or gain heat as it is transported so that there is less control of the exhaust emission.

SUMMARY OF THE INVENTION

An exhaust gas recirculation (EGR) cooling system includes a valve and a cooler. Exhaust gas from the engine is cooled and unburned gas is recycled back to the engine. Hot fluid exhaust gas from the engine enters the system on a hot side and is returned to the engine on a cold side. The cooler is divided into a shell section for a cooling fluid and a plurality of tubes for the hot fluid. The cooling fluid enters the cooler from the valve and exits the shell through an outlet nozzle. In the preferred embodiment, the tubes are such as are available under the trademark flexfin™.

The valve is attached to the hot side of the cooler and is connected to a motor which controls the opening and the closing of the valve. The valve includes a cooling fluid inlet and a hot fluid inlet and has a first chamber and a second chamber.

The cooling fluid continuously flows in through the cooling fluid inlet and into the first chamber. The motor opens the valve to allow the hot fluid to flow into the valve. The subject invention allows the cooling fluid to circulate around the valve in the first chamber, reducing the amount of heat transfer from the hot fluid to the valve components, prolonging the life of the valve. The cooling fluid flows into the second chamber and continues to remove heat from the hot fluid before entering the cooler. The hot fluid continues to transfer heat to the cooling fluid in the shell as the hot fluid flows through the tubes and exits the tubes at the cold side A. As the hot fluid is cooled, the unburned gas in the hot fluid is recycled to be burned by the engine.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
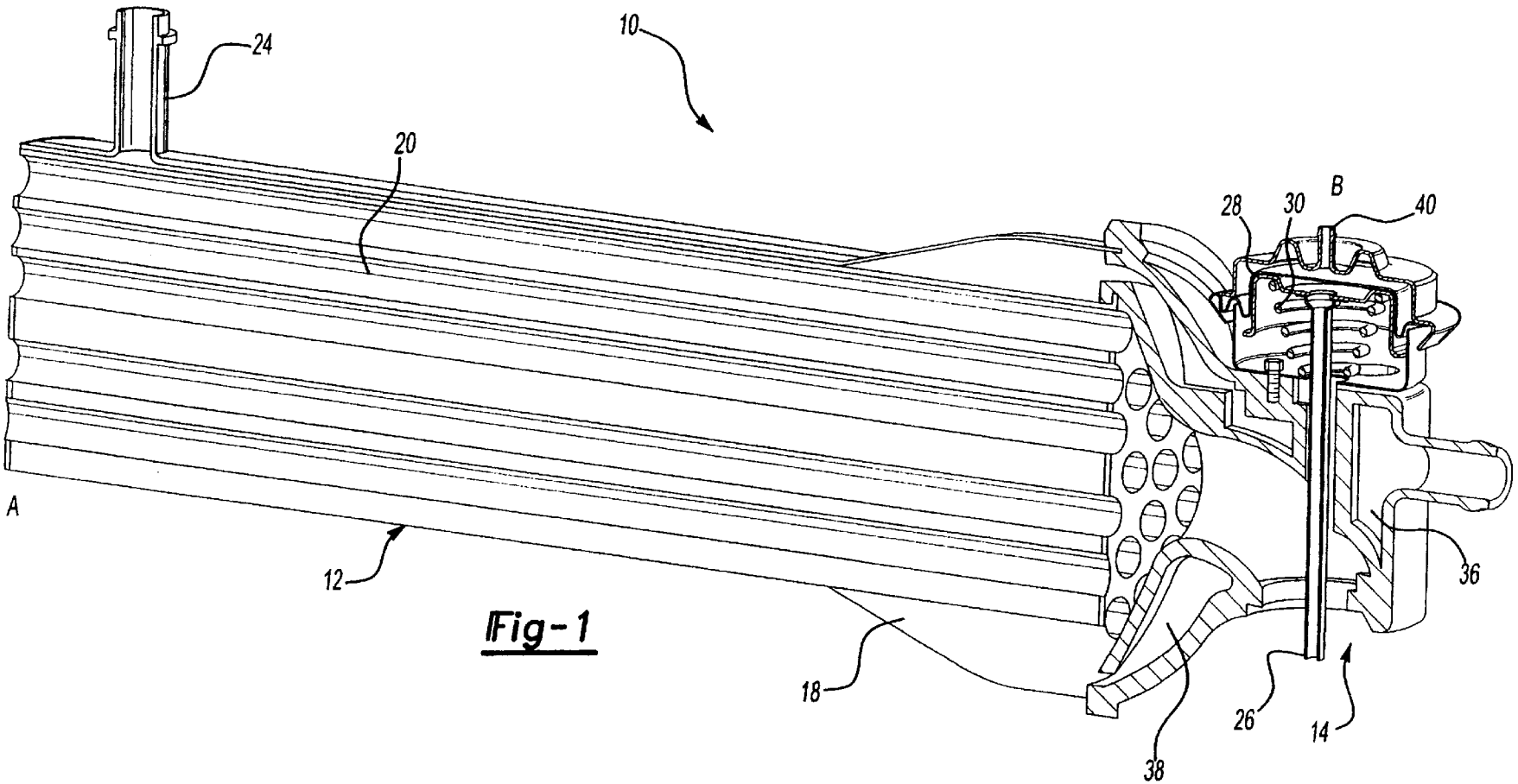
FIG. 1 is a schematic of the exhaust gas recirculation system.

Referring to the Figures, wherein like numerals indicate like or corresponding parts throughout the several views, an exhaust gas recirculation (EGR) cooling system 10 is shown in FIG. 1. The system 10 cools the exhaust gas from an engine and recycles the unburned gas back to the engine. The system 10 has a hot side B where a hot fluid, i.e. the exhaust gas from the engine, enters the system and a cold side A where the hot fluid has condensed and is returned to the engine. The EGR system 10 comprises a cooler 12 and a valve 14. To those skilled in the art, the cooler 12 acts as a shell and tube heat exchanger. The cooler 12 is divided into a shell section 18 for a cooling fluid and a plurality of tubes 20 for the hot fluid. The cooling fluid enters the cooler 12 from the valve 14 and exits the shell 18 through an outlet nozzle 24. In the preferred embodiment, the tubes 20 are such as are available under the trademark flexfin™, which have a plurality of spirals for tube walls to increase heat transfer between the hot fluid and the cooling fluid.

Figure 2:
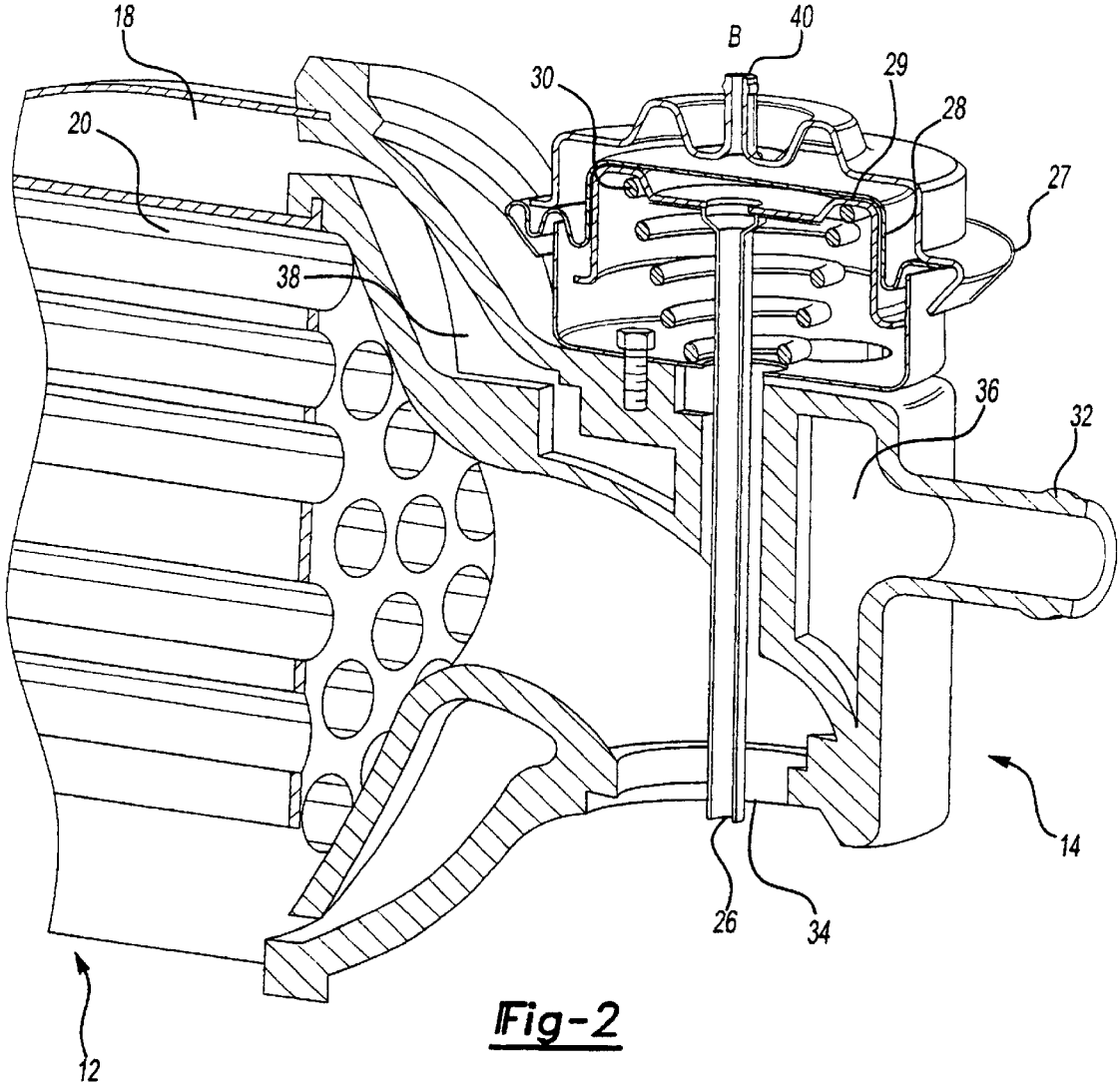
FIG. 2 is a side view of the EGR valve.

The valve 14 is attached to the hot side B of the cooler 12 and has a nozzle 40 which is connected to an electric or pneumatic motor. The motor controls the opening and closing of the valve 14. As seen in FIG. 2, the valve components includes a stem 26, an upper housing 27, a diaphragm 28, a diaphragm plate 29, and a spring 30. The valve 14 has a cooling fluid inlet 32 and a hot fluid inlet 34. The valve 14 also has a first chamber 36 and a second chamber 38.

The valve 14 is connected by any known means to the cooler 12. The cooling fluid continuously flows in through the cooling fluid inlet 32 of the valve 14 and into the first chamber 36. When the motor opens the valve 14, the hot fluid flows into the valve 14. In the prior art, the hot fluid heats up the valve components which shortens the life of the valve 14. The subject invention allows the cooling fluid to circulate around the valve stem 26, the diaphragm 28, the diaphragm plate 29, and the spring 30 in the first chamber 36. The cooling fluid reduces the amount of heat transfer from the hot fluid to the valve components which in turn prolongs the life of the valve 14. Next, the cooling fluid flows into the second chamber 38 of the valve 14 and continues to remove heat from the hot fluid before it enters the cooler 12. As the hot fluid flows through the tubes 20, the hot fluid continues to transfer heat to the cooling fluid in the shell 18. The hot fluid exits the tubes 20 at the cold side A. As the hot fluid is cooled, the unburned gas in the hot fluid is recycled to be burned by the engine.

There are many additional advantages to connecting and positioning the valve 14 before the cooler 12. First, the valve 14 remains free of contaminants from the cooling of the hot fluid which happens when the valve 14 is placed after the cooler 12. The second benefit is the hot fluid achieves a more consistent amount of cooling which makes the engine more efficient. If the valve 14 were spaced separately from the cooler, the additional tubing would allow the hot fluid to lose and gain heat as it was transported. Third, by attaching the valve 14 to the cooler 12, the engine achieves better control of the exhaust emissions because the hot fluid temperature out of the cooler is better controlled.

The invention has been described in an illustrative manner, and it is to be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. An exhaust gas recirculation system comprising:

a valve to control a flow of an exhaust fluid entering said system;

at least one tube in fluid communication with said valve, said at least one tube carrying said exhaust fluid from said valve and out of said system;

a valve chamber surrounding a portion of said valve, said valve including a cooling fluid inlet; and a shell portion defining a cooler chamber in fluid communication with said valve chamber and surrounding said at least one tube.

2. The system as recited in claim 1 wherein an actuator controls a degree of opening of said valve.

3. The system as recited in claim 1 wherein said valve includes a stem having a first end and an opposing second end, and said first end of said stem is attached to and actuated by a diaphragm; a spring attached to said diaphragm and surrounding a portion of said stem, and a poppet attached to said opposing second end of said valve.

4. The system as recited in claim 3 wherein said stem, said diaphragm, and said spring are in said valve chamber.

5. The system as recited in claim 1 wherein said cooling fluid flows through said valve chamber to reduce heat transfer to said valve and further through said shell portion to remove heat from said exhaust fluid flowing through said at least one tube.

6. The system as recited in claim 1 wherein said valve further includes a exhaust fluid inlet.

7. The system as recited in claim 1 wherein each of said at least one tube is helical.

8. An exhaust gas recirculation system comprising:

a valve to control a flow of an exhaust fluid entering said system through a hot fluid inlet;

an actuator to control a degree of opening of said valve;

at least one tube in fluid communication with said valve said exhaust fluid from said valve and out of said system;

a valve chamber surrounding a portion of said valve, said valve including a cooling fluid inlet; and a shell portion defining a cooler chamber in fluid communication with said valve chamber and surrounding said at least one tube, said shell portion including a cooling fluid outlet.

9. The system as recited in claim 8 wherein said valve includes a stem having a first end and an opposing second end, and said first end of said stem is attached to and actuated by a diaphragm; a spring attached to said diaphragm and surrounding a portion of said stem, and a poppet attached to said opposing end of said valve.

10. The system as recited in claim 8 wherein each of said at least one tube is helical.

11. The system as recited in claim 8 wherein said valve includes a stem having a first end and an opposing second end, and said first end of said stem is attached to and actuated by a diaphragm, a spring attached to said diaphragm and surrounding a portion of said stem, and a poppet attached to said opposing second end of said valve, and wherein said stem, said diaphragm, and said spring are in said valve chamber.

12. An exhaust gas recirculation system comprising:

a valve to control a flow of an exhaust fluid entering said system;

at least one tube in fluid communication with said valve, said at least one tube carrying said exhaust fluid from said valve and out of said system;

a valve chamber including a cooling fluid inlet to allow entry of a cooling fluid into said system, and said valve chamber further includes a first chamber and a second chamber for heat removal from said exhaust fluid prior to entry into said shell portion;

a shell portion defining a cooler chamber in fluid communication with said valve chamber and surrounding said at least one tube to remove hat from said exhaust fluid, said shell portion including a cooling fluid outlet to convey said cooling fluid from said system.

13. An exhaust gas recirculation system comprising:

a valve to control a flow of an exhaust fluid entering said system through a hot exhaust inlet;

an actuator to control a degree of opening of said valve to control a flow of said exhaust fluid into said valve and said system;

at least one tube in fluid communication with said valve, said at least one tube carrying said exhaust fluid from said valve and out of said system; and a valve chamber surrounding a portion of said valve, said valve including a cooling fluid inlet to allow entry of a cooling fluid into said system, said cooling fluid reducing heat transfer to said valve and said valve chamber includes a first chamber and a second chamber for heat removal from said exhaust fluid prior to entry into said shell portion; and a shell portion defining a cooler chamber in fluid communication with said valve chamber and surrounding said at least one tube to remove heat from said exhaust fluid, said shell portion including a cooling fluid outlet to convey said cooling fluid from said system.

14. An exhaust gas recirculation system comprising:

a valve including a hot exhaust inlet, a stem having a first end and an opposing second end, and said first end of said stem is attached to and actuated by a diaphragm; a spring attached to said diaphragm and surrounding a portion of said stem, and a poppet attached to said opposing end of said stem;

an actuator to control a degree of opening of said valve;

at least one tube in fluid communication with said valve, said at least one tube carrying said exhaust fluid from said valve and out of said system; and a valve chamber including a first chamber, a second chamber, and a cooling fluid inlet said valve chamber surrounding a portion of said valve, and a shell portion defining a cooler chamber in fluid communication with said valve chamber and surrounding said at least one tube said shell portion including a cooling fluid outlet.

15. A method for cooling an exhaust fluid comprising the steps of:

opening a valve to control a flow of said exhaust fluid into an exhaust gas recirculation system;

removing heat from said valve by flowing said cooling fluid into a valve chamber surrounding said valve; and removing heat from said exhaust fluid by further passing said cooling fluid through a shell portion of a cooler in fluid communication with said valve chamber, and said shell portion enclosing a plurality of tubes in fluid communication with said valve and through which said exhaust fluid flows.

16. The method as recited in claim 15 wherein each of said at least one tube is helical.

* * * * *

UNITED STATES PATENT AND TRADEMARK OFFICE

CERTIFICATE OF CORRECTION

PATENT NO. : 6,647,971 B2
DATED : November 18, 2003
INVENTOR(S) : Vaughan et al.

It is certified that error appears in the above-identified patent and that said Letters Patent is hereby corrected as shown below:

Column 3,
Line 9, please insert -- chamber -- after "valve" and before "including"
Line 12, please insert -- including a cooling fluid outlet -- after "tube" and before "."
Line 36, please insert -- said at least one tube carrying -- after "valve" and before "said"

Signed and Sealed this

Ninth Day of March, 2004

JON W. DUDAS
*Acting Director of the United States Patent and Trademark Office*